United States Patent [19]

Shaw

[11] Patent Number: 4,878,818

[45] Date of Patent: Nov. 7, 1989

[54] COMMON COMPRESSION ZONE ACCESS PORTS FOR POSITIVE DISPLACEMENT COMPRESSOR

[75] Inventor: David N. Shaw, Manlius, N.Y.

[73] Assignee: Carrier Corporation, Syracuse, N.Y.

[21] Appl. No.: 214,974

[22] Filed: Jul. 5, 1988

[51] Int. Cl.[4] ..... F04B 49/02

[52] U.S. Cl. ..... 417/308; 417/310; 417/440

[58] Field of Search ..... 417/308, 309, 310, 440, 417/283, 302, 304; 418/261 A

[56] References Cited

U.S. PATENT DOCUMENTS

| | | | |
|---|---|---|---|
| 3,874,828 | 4/1975 | Herschler et al. | 418/201 A X |
| 4,042,310 | 8/1977 | Schibbye et al. | 417/310 |
| 4,373,866 | 2/1983 | Zimmern | 417/310 X |
| 4,610,612 | 9/1986 | Kocher | 417/310 X |

FOREIGN PATENT DOCUMENTS

| | | | |
|---|---|---|---|
| 2923796 | 12/1979 | Fed. Rep. of Germany | 417/310 |
| 0131791 | 7/1984 | Japan | 418/201 A |
| 8606798 | 11/1986 | PCT Int'l Appl. | 417/310 |

*Primary Examiner*—Carlton R. Croyle
*Assistant Examiner*—Leonard P. Walnoha
*Attorney, Agent, or Firm*—David J. Zobkiw

[57] ABSTRACT

In a compressor of the type in which there is a movable trapped volume such as a screw or scroll type of compressor the trapped volume moves into and out of fluid contact with one or more valves. The valve(s) can provide fluid communication between the trapped volume and either suction for unloading or discharge for $V_i$ control.

16 Claims, 6 Drawing Sheets

COMMON COMPRESSION ZONE ACCESS PORTS FOR POSITIVE DISPLACEMENT COMPRESSOR

BACKGROUND OF THE INVENTION

Positive displacement compressors are normally operated over a range of capacities and thus require some means for modifying their operation if efficient operation is to be maintained. It is desirable to be able to unload a compressor to various percentages of capacity in fixed increments or over an entire range. Simultaneously, it is desirable to efficiently maintain the desired discharge pressure to suction pressure ratio, or $V_i$, for meeting system requirements. To meet these various requirements, a number of individual controls are used. In screw compressors, for example, capacity control is conventionally achieved by the use of a slide valve. The slide valve is located in and reciprocates in the cusp of the housing formed between the intersecting bores for the two rotors. The slide valve thus defines a portion of each bore and thereby compromises the integrity of the housing as well as making for a complicated device. The slide valve is reciprocatably positionable with respect to the axes of the rotors and can thus effectively change the start of compression by changing the closing point of the suction stroke and thereby controlling the amount of gas trapped and compressed.

SUMMARY OF THE INVENTION

The present invention employs compression zone access ports which allow either discharge to high side or bypass to low side. Because the ports just intersect the bores for the rotors, the primary integrity of the rotor housing is maintained. Also, because the ports can have a dual use, the number of ports can be reduced which, in turn, permits a greater flexibility in locating the ports.

It is an object of this invention to provide common compression zone access ports allowing either discharge to high side or bypass to low side in screw or scroll type positive displacement compressors.

It is another object of this invention to allow sufficient control of volume ratio while still maintaining the ability to unload a screw compressor.

It is a further object of this invention to eliminate the need for slide valves in screw compressors.

It is an additional object of this invention to provide compression zone access ports and a method by which they can be selectively used for $V_i$ control or capacity control. These objects, and others as will become apparent hereinafter, are accomplished by the present invention.

Basically, in a preferred embodiment, a screw compressor is provided with a plurality of valved access ports which can provide fluid communication with the interlobe volume at various stages of compression. The access ports preferably have selective communication with either the inlet or the outlet to provide capacity control and $V_i$ control, respectively. In a second embodiment, a scroll compressor is similarly controlled. However, because scroll compressors have symmetrically located trapped volumes, a valve is required at a corresponding location for each trapped volume.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENTS

Figure 1A:
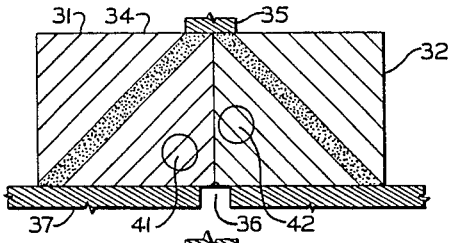
FIGS. 1A–F show unwrapped rotors and sequentially illustrate the movement of a trapped volume between intake cutoff and discharge.
Figure 1B:
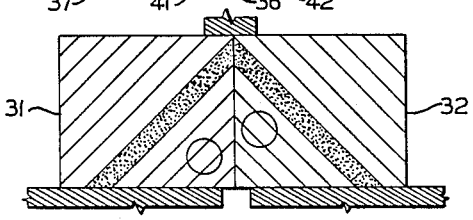
Figure 1C:
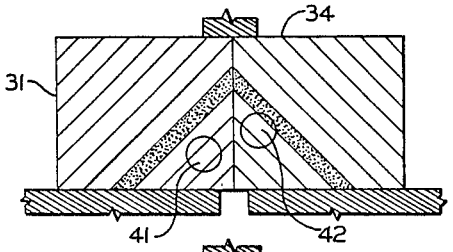
Figure 1D:
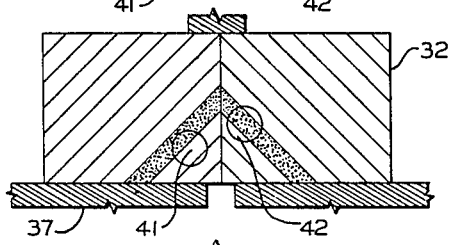
Figure 1E:
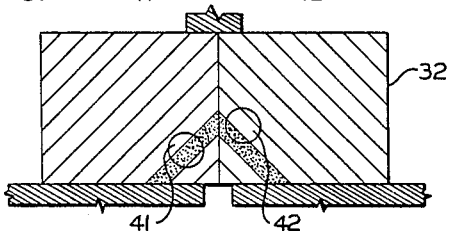
Figure 1F:
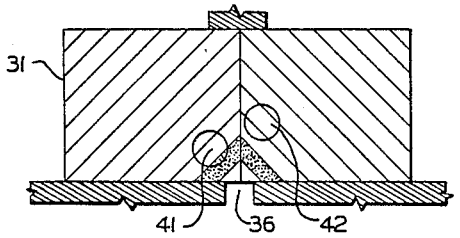

In FIGS. 1A–F and FIG. 3, the numeral 31 represents the unwrapped male rotor and the numeral 32 represents the unwrapped female rotor. Axial suction port 34 is located in end wall 35 and axial discharge port 36 is located in end wall 37. The stippling in FIGS. 1A–F represents the trapped volume of refrigerant starting with the cutoff of suction port 34 in FIG. 1A and progressing to a point just prior to communication with axial discharge port 36 in FIG. 1F. Two generally radial ports, 41 and 42, are provided intermediate walls 35 and 37. However, ports 41 and 42 could also be axially located in wall 37 since, as illustrated, the stippled trapped volumes move with respect to wall 37. In FIG. 1C, the trapped volume is just being exposed to port 42. In FIG. 1C to F, the trapped volume is illustrated as being in contact with one or both of ports 41 and 42. Ports 41 and 42 are selectively connectable to the inlet for unloading or capacity control or to the discharge for $V_i$ control and each represents a different step of unloading or of $V_i$.

Figure 2:
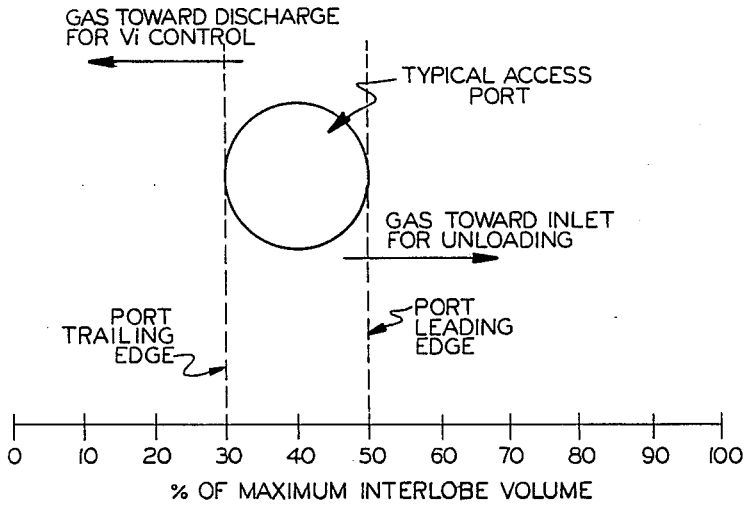
FIG. 2 is a graphic representation of the coaction of a typical port and the interlobe volume.
Figure 3:
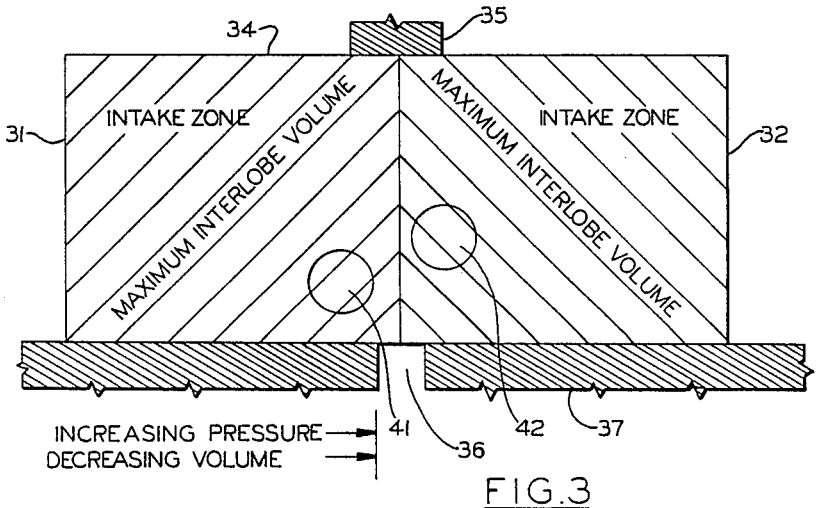
FIG. 3 is an enlarged view corresponding to FIG. 1.

From the foregoing it is clear that each of ports 41–42 serves two functions. These functions are alternative so that the opening of one fluid path for one function requires the blocking of the corresponding path for the alternative function. Referring now to FIG. 2 and taking port 41 as typical and illustrative of the coaction of the interlobe volume with port 42 also, it will be noted that the trailing and leading port edges of port 41 are, respectively, located at 30% and 50% of the maximum interlobe volume. The significance of the positions of the trailing and leading port edges is that the trailing port edge represents the final point where the trapped volume is capable of communicating with the inlet for suction bypass or to discharge for low $V_i$ operation. Similarly, the leading port edge represents the point when the trapped volume is first capable of communicating with the inlet for suction bypass or to the discharge. Thus, if port 41 is connected to discharge, there will be a nominally 50% volume reduction prior to communication. If port 41 is connected to suction, there will be nominally 30% capacity. Port 42 provides a further choice of capacity and $V_i$ since it is located at different ranges of interlobe volume.

Figure 4:
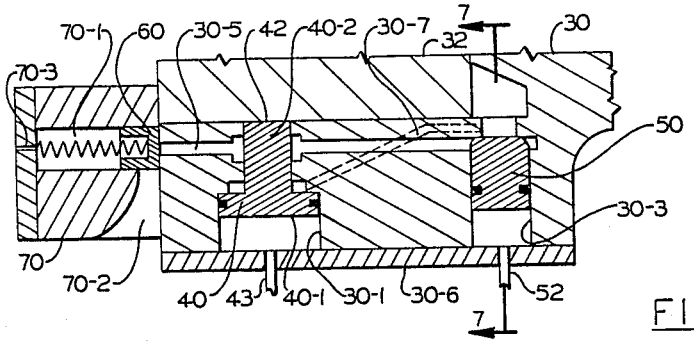
FIGS. 4–6 illustrate the various combinations of valve positions for a first embodiment of the present invention.
Figure 5:
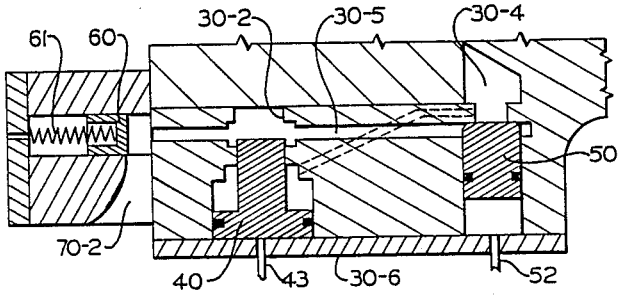
Figure 6:
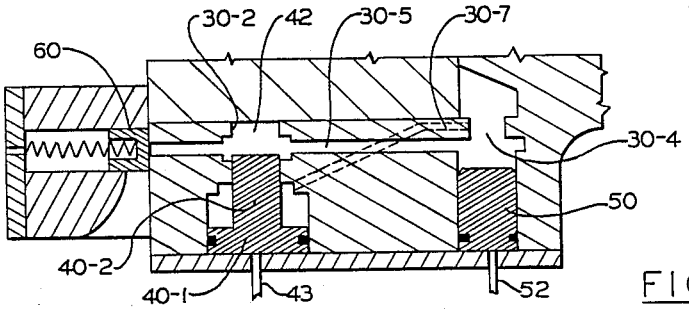
Figure 7:
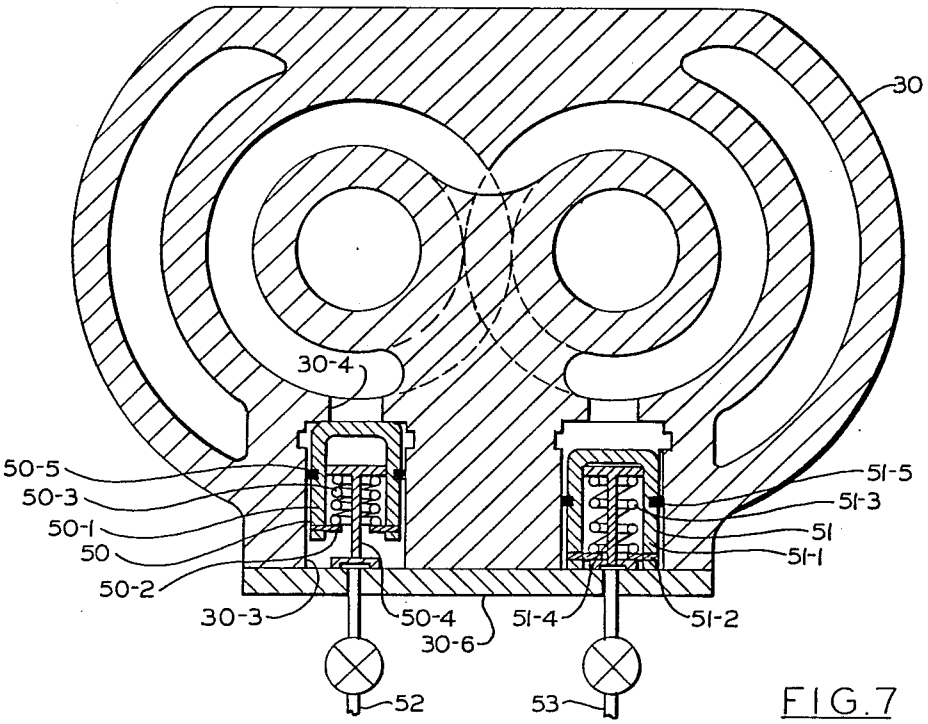
FIG. 7 is a sectional view taken along line 7–7 of FIG. 4.

Referring now to FIGS. 4–6 and taking port 42 as illustrative of the coaction of the interlobe volume with port 41 also, it will be noted that fluid pressure actuated piston valve 40 is located in compressor housing 30 and controls port 42. Piston valve 40 includes a larger head portion 40-1 which reciprocates in bore 30-1 and a smaller stem portion 40-2 which reciprocates in bore 30-2. Discharge, or other suitable pressure, is selectively supplied via line 43, which is connected through cover 30-6 to bore 30-1 to act on the large area of the head portion 40-1 to tend to force piston valve 40 into the FIG. 4 position closing port 42. The pressure supplied via line 43 is opposed by suction pressure which is continuously supplied to the other side of head portion 40-1 via bore 30-7 which is shown in phantom. Piston valve 50 which will be described in more detail with respect to FIG. 7 is located in bore 30-3 and controls fluid communication between bore 30-4 and bore 30-5. Piston valve 50 is biased to the closed position of FIG. 4 by discharge, or other suitable pressure, selectively supplied to bore 30-3 by line 52 which is connected to bore 30-3 through cover 30-6. The pressure supplied via line 52 is opposed by the suction pressure which is continuously supplied via bore 30-4. Spring biased discharge check valve 60 is reciprocatably located in bore 70-1 of valve cover 70 and controls fluid communication between bore 30-5 and discharge through discharge manifold passageway 70-2 which is in direct fluid communication with fixed axial discharge port 36. Referring specifically to FIG. 4, discharge or other suitable fluid pressure is supplied to lines 43 and 52 closing valves 40 and 50 while spring 61 and discharge manifold pressure from the manifold supplied via bleed 70-3 biases valve 60 closed. Assuming that ports 41 and 42 are both closed, the screw compressor would be at full capacity. If, as illustrated in FIG. 5, pressure is no longer supplied via line 43 but is supplied via line 52, suction pressure supplied via line bore 30-7 will act on piston head 40-1 in conjunction with the trapped volume pressure acting on the end of stem portion 40-2 causing piston 40 to move to the FIG. 5 position establishing fluid communication via bore 30-2 between the trapped volume at port 42 and bore 30-5. Since the trapped volume will be at an elevated pressure it acts on valve 60 and overcomes the bias of spring 61 and the discharge manifold pressure acting on valve 60 to open valve 60 and establish fluid communication between the trapped volume and discharge and to thereby reduce the $V_i$ as compared to the FIG. 4 position of the valves. Referring now to FIG. 6, if fluid pressure is no longer supplied to either line 43 or 52, suction pressure supplied via line 44 acts on piston head 40-1 in conjunction with the trapped volume pressure acting on the end of stem portion 40-2 to move valve 40 to the FIG. 6 position and, as explained in detail with respect to FIG. 7, a spring bias acts on valve 50 to move valve 50 to the FIG. 6 position. With both valve 40 and 50 thus opened, a fluid communication is established between the trapped volume and suction serially via port 42, bore 30-2, bore 30-5, bore 30-3 and bore 30-4 to thereby unload the compressor. Valve 60 is kept closed since bore 30-5 now has a direct fluid communication with suction and the bore 70-1 and bleed 70-3 keep the spring side of valve 60 at discharge manifold pressure. Port 41 would be similarly controlled.

Referring now to FIG. 7 which is a sectional view taken along line 7—7 of FIG. 4, it will be noted that valve 50 is shown in the FIG. 4 position but that a second identical valve 51 is illustrated in the FIG. 6 position of valve 50. Valves 40, 50 and 60 coact with port 42 and corresponding valves, of which only 51 is illustrated, coact with port 41. Thus ports 41 and 42 are controlled in the same fashion by corresponding structure. Valves 50 and 51 each include a hollow piston valve member 50-1 and 51-1, respectively, spring retainers 50-2 and 51-2, springs 50-3 and 51-3, spring holders 50-4 and 51-4 and O-rings 50-5 and 51-5. Valve 50 is held closed by fluid pressure supplied via line 52 which is opposed by the fluid pressure in the bore 30-4 together with the bias of spring 50-3. Hence, valve 50 is in its FIG. 6 position and valve 51 is in the FIG. 7 position unless fluid pressure is supplied via lines 52 and 53, respectively.

The foregoing description did not specifically treat the supplying and exhausting of pressure for positioning the valves. It is common to sense various parameters in a compressor and/or the refrigeration system to which it is connected and to control the compressor responsive thereto. Typically, the demand is sensed and the compressor controlled for its most efficient operation for the current demand. In screw compressors, for example, the slide valve position is sometimes sensed as part of the compressor control. For the current invention, the control would only require the conventional sensing of parameters and rather than positioning a slide valve, piston type valves are moved responsive to the supplying and exhausting of fluid pressure. The position of valves 40, 50 and 51 and the other valves (not illustrated) could be sensed, the position of the valves (not illustrated) controlling the supplying of fluid pressures via lines 43, 52, 53 and the other lines (not illustrated) could be sensed, or the pressure in lines 43, 52, 53 and the other lines (not illustrated) could be sensed.

Figure 8:
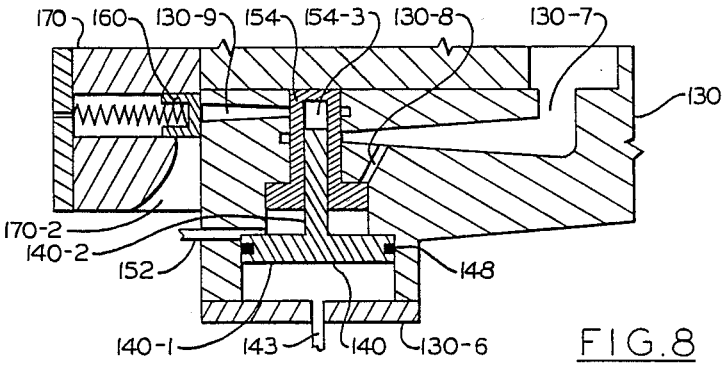
FIGS. 8–10 illustrate the various combinations of valve position for a second embodiment of the present invention.
Figure 9:
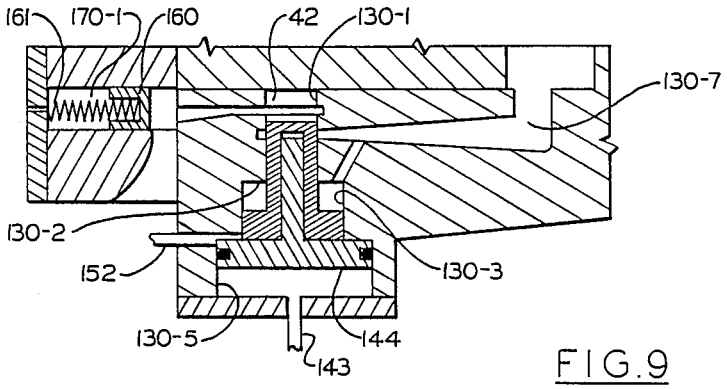
Figure 10:
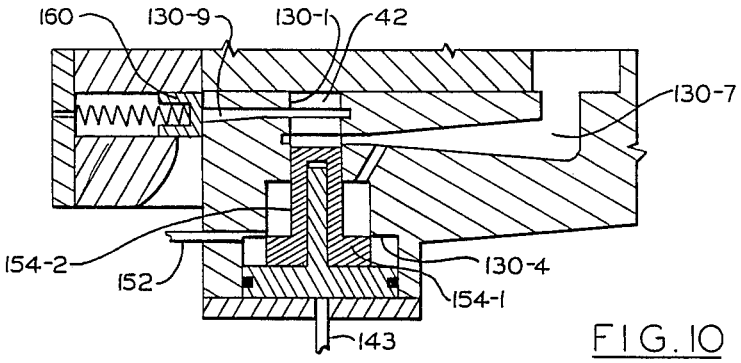
Figure 11:
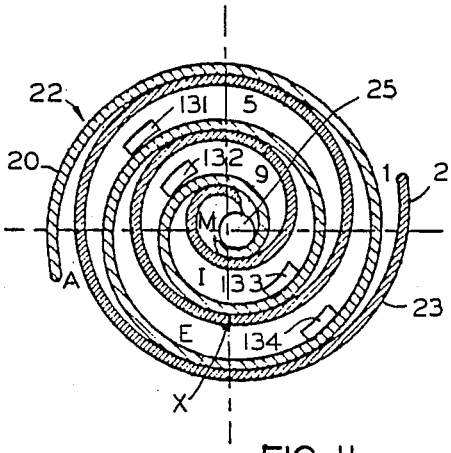
FIGS. 11–14 illustrate the use of the present invention in a scroll compressor.
Figure 12:
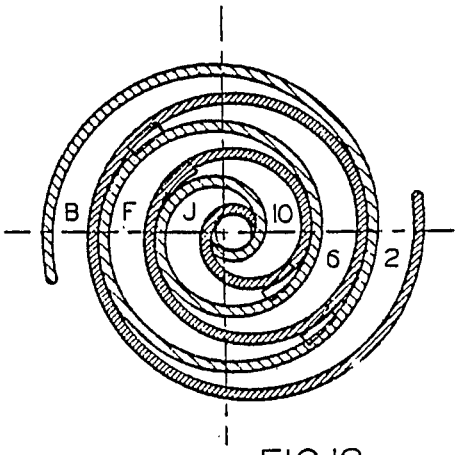
Figure 14:
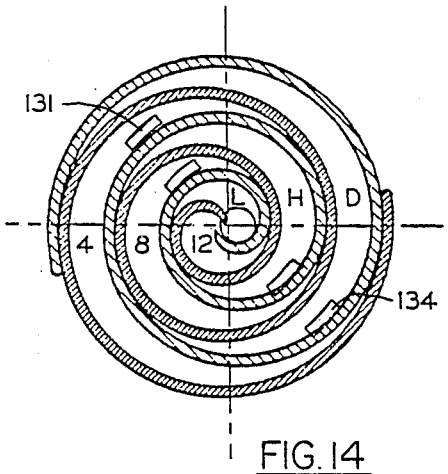
Figure 13:
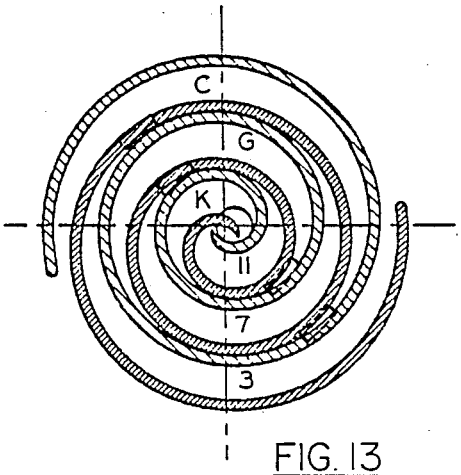

FIGS. 8–10 illustrate a second embodiment of the present invention and again taking port 42 as illustrative of the coaction of the interlobe volume with port 41 also, it will be noted that the function of valve 50 has been incorporated into the valve 140 while valve 160 is structurally and functionally identical to valve 60 although corresponding structure has been numbered 100 higher. Valve 140 is located in compressor housing 130 and controls port 42. Port 42 is located at one end of bore 130-1 which is separated from bore 130-3 by shoulder 130-2 while bore 130-3 is separated from bore 130-5 by shoulder 130-4. Bore 130-5 is sealed by cover 130-6 which receives line 143 which is connected to a suitable source of pressure. Line 152 is in fluid communication with bores 130-3 and 5 and is connected to a suitable source of fluid pressure such as discharge. Bore 130-7 provides fluid communication between suction and bore 130-1. Bore 130-8 provides fluid communication between bore 130-7 and bore 130-3. Bore 130-9 provides fluid communication between bore 130-1 and discharge. Valve 140 is made up of two movable piston members 144 and 154. Piston member 144 includes an enlarged head 140-1 and stem 140-2. Head 10-1 carries an O-ring 148 which provides a fluid seal with bore 130-5. Piston member 154 is essentially hat-shaped with enlarged annular piston portion 154-1 being reciprocatably located in bore 130-3 and tubular piston portion 154-2 being reciprocatably located in bore 130-1. Tubular piston portion 154-2 has a bore 154-3 which receives stem 140-2 and clearances, grooves or any other suitable conventional structure is provided to control or eliminate any dashpot coaction between stem 140-2 and bore 154-3. Referring now specifically to FIG. 8, which corresponds to FIG. 4 and represents full capacity operation, discharge or other suitable fluid pressure is supplied to lines 143 and 152 so that the fluid pressure acting on head 140-1 forces piston member 144 upwardly and against shoulder 130-4. Similarly, the fluid pressure supplied via line 152 acts on annular piston portion 154-1 forcing it against shoulder 130-2 causing tubular piston portion 154-2 to block fluid communication between bores 130-7 and 130-9 and to block port 42. The fluid pressure supplied via line 152 and acting on annular piston portion 155 is ineffectively opposed by the suction pressure which is supplied to bore 130-3 via bore 130-8 and by the trapped volume pressure acting on the end of tubular piston portion 154-2.

Referring to FIG. 9, which corresponds to FIG. 5 and reduced $V_i$ operation, fluid pressure is supplied via line 143 but not line 152. Fluid pressure acting on head 140-1 forces piston member 144 against shoulder 130-4. The pressure at port 42 acts on the end of tubular piston portion 154-2 and suction pressure supplied to bore 130-3 via line 130-8 acts in conjunction therewith on annular piston portion 154-1 causing piston member 154 to move downward until annular piston portion 154-1 engages head 140-1. Alternatively, movement of piston member 154 can be limited by stem 140-2 engaging the end of bore 154-3. In the FIG. 9 position, tubular piston portion 154-2 blocks fluid communication between bores 130-7 and 130-1 thereby isolating the suction, but provides fluid communication between port 42 and bore 130-9. Since port 42 is in fluid communication with a trapped volume which is at an elevated pressure, this pressure acts on valve 160 and overcomes the bias of spring 161 and the discharge manifold pressure acting on valve 160 opening valve 160 and establishing fluid communication between the trapped volume and discharge 170-2 to hereby reduce the $V_i$ as compared to the FIG. 8 position.

FIG. 10 corresponds to FIG. 6 and represents an unloaded position. No fluid pressure is supplied via lines 143 and 152 so that pressure at port 42 acts on the tubular piston portion 154-2 in conjunction with the pressure in bore 130-7 which is supplied to bore 130-3 via bore 130-8. This forces piston member 154 downwardly into engagement with piston member 144 and this forces piston member 144 into engagement with cover 130-6. As a result, port 42 is in fluid communication with bores 130-9 and 130-7. However, since bore 130-9 is blocked by spring biased valve 160, fluid communication is between the trapped volume at port 42 and suction via bore 130-7. With this unvalved path between the trapped volume and suction, valve 160 is closed and isolates bore 130-7 from discharge manifold passageway 170-2. The controlling of the supplying of fluid pressure for actuating valve 140 would be in a manner discussed above with respect to the FIGS. 4–7 embodiment.

In FIGS. 11–14, the numeral 20 generally indicates the fixed scroll having a wrap 22 and the numeral 21 generally indicates the orbiting scroll having a wrap 23 of a scroll compressor. The chambers labeled A–M and 1–12 each serially show the suction, compression and discharge steps with chamber M being the common chamber formed at discharge 25 when the device is operated as a compressor. It will be noted that chambers 4–11 and D–K are each in the form of a helical crescent or lunette approximately 360° in extent with the two ends being points of line contact or minimum clearance between the scroll wraps. If, for example, point X in FIG. 1 represents the point of line contact or of minimum clearance separating chambers 5 and 9 it is obvious that there is tendency for leakage at this point from the high pressure chamber 9 to the lower pressure chamber 6 and that any leakage represents a loss or inefficiency. To minimize the losses from leakage, it is necessary to maintain close tolerances and to run at high speed.

Figure 15:
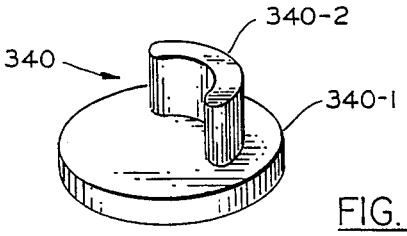
FIG. 15 is a perspective view of a valve suitable for use in the FIGS. 11–14 embodiment.

FIGS. 11–14 represent the adaptation of the present invention to a scroll compressor. Axial ports 131 and 132 are located on the outer side of fixed wrap 22 while axial ports 133 and 134 are on the inner side of fixed wrap 22. Because a scroll compressor has pairs of symmetrically located trapped volumes whereas each trapped volume in a screw compressor has a portion defined by each rotor, it is necessary to have pairs of valves opened to achieve balanced operation. So ports 131 and 134 Would be operated simultaneously and in the the same manner. Ports 132 and manner. Except that ports 131–134 are of a crescent or arcuate shape they are identical in function to corresponding ports 41 and 42 of FIGS. 1–6 and 8–10 and would coact with a check valve in the discharge cavity such as valve 60 and a bypass piston valve in the suction cavity such as valve 50. Preferably the valve 50 equivalent would control the communication to a pair of ports, such as 131 and 134, which are operated together. FIG. 15 illustrates valve 340 which is typical of the valves blocking ports 131–134. Valve 340 includes an piston portion 340-1 and an arcuate extension 340-2 for receipt in corresponding port 131–134 and a corresponding bore such as the equivalent of embodiment and would control fluid communication in the same 30-2. Valve 340 corresponds to valve 40 of the FIGS. 4–7 manner. It should be noted that ports 131–134 cannot be wider than a scroll wrap if leakage between trapped volumes is to be minimized. It should also be noted that each port 131–134 could be unique because it is on a different location/side on a spiral and thus is at a different radius.

Although a preferred embodiment of the present invention has been illustrated and described, other changes will occur to those skilled in the art. For example, there can be other numbers of ports, such as one or three, rather than the two illustrated. Some, but not all, of the ports may have a single fluid communication rather than two. Also, more than one port can be open at a time so as to extend the unloading range thus reducing the amount of work done on the fluid or alternatively to cause early discharge of fluid delivered at the discharge manifold passageway 70-2. It is therefore intended that the scope of the present claims is to be limited only by the scope of the appended claims.

What is claimed is:

1. A method for operating a positive displacement compressor of the type where trapped volumes are established and moved relative to fixed structure as part of a compression cycle comprising the steps of:

providing at least one port in the fixed structure at a location having fluid communication with a trapped volume during a portion of its compression cycle;

blocking the one port when full output of the compressor is desired;

establishing communication between a trapped volume and the inlet to the compressor via the one port when it is desired to unload the compressor; and establishing communication between a trapped volume and the discharge to the compressor via the one port when it is desired to reduce the discharge pressure to suction pressure ratio.

2. The method of claim 1 wherein the one port has fluid communication with each trapped volume established in the compression cycle.

3. The method of claim 1 wherein the one port is a port of at least one pair of ports with each port of the one pair having fluid communication with different trapped volume from each other.

4. A method for operating a positive displacement compressor of the type where trapped volumes are established and moved relative to fixed structure as part of a compression cycle comprising the steps of:

providing a plurality of ports in the fixed structure at a spaced locations such that each trapped volume is in fluid communication with at least one of the plurality of ports during its compression cycle;

blocking all of the ports when full output of the compressor desired;

establishing fluid communication with the inlet of the compressor via a selected one of the plurality of ports whenever a trapped volume is in fluid communication with the selected port when it is desired to achieve a degree of unloading of the compressor represented by the location of the selected port;

establishing fluid communication with the discharge of the compressor via a selected one of the plurality of ports whenever a trapped volume is in fluid communication with the selected port when it is desired to reduce the discharge pressure to suction pressure ratio to a degree represented by the location of the selected port.

5. The method of claim 4 wherein each of the plurality of ports is one port of a pair of symmetrically located ports with each port of each pair having fluid communication with different trapped volumes from each other.

6. The method of claim 5 wherein each pair of symmetrically located ports is controlled in the same fashion.

7. A positive displacement compressor means having an inlet and an outlet comprising:

fixed and movable means coacting to establish trapped volumes in a compression cycle in which said trapped volumes sequentially are cut off from fluid communication with said inlet, moved relative to said fixed means and brought into fluid communication with said outlet;

port means in said fixed means at a location having fluid communication with a trapped volume during said compression cycle;

first fluid passage means for providing fluid communication between a trapped volume and said inlet via said port means; and second fluid passage means for providing fluid communication between a trapped volume and said outlet via said port means; and valve means coacting with said port means and having a first position in which said valve means blocks said port means, a second position in which said valve means permits fluid communication between a trapped volume and said outlet via said port means to reduce the discharge pressure to suction pressure ratio and a third position in which said valve means permit fluid communication between a trapped volume and said inlet via said port means to unload said compressor.

8. The compressor means of claim 7 further including a second port means and a second valve means coacting with said second port means.

9. The compressor means of claim 7 wherein said compressor means is a screw compressor.

10. The compressor means of claim 7 wherein said port means and said valve means are generally radially located in said compressor means.

11. The compressor means of claim 7 wherein said port means and said valve means are generally axially located in said compressor means.

12. The compressor means of claim 7 wherein said compressor means is a scroll compressor.

13. The compressor means of claim 12 wherein said port means is located in a fixed scroll in said compressor means.

14. A positive displacement compressor means having an inlet and an outlet comprising:

fixed and movable means coacting to establish trapped volumes in a compression cycle in which said trapped volumes sequentially are cut off from fluid communication with said inlet, moved relative to said fixed means and brought into fluid communication with said outlet;

a plurality of port means in said fixed means at spaced locations such that each of said plurality of port means is in fluid communication with a trapped volume during said compression cycle;

each of said plurality of port means having associated therewith:

(a) first fluid passage means for providing fluid communication between a trapped volume and said inlet via a corresponding one of said port means, (b) second fluid passage means for providing fluid communication between a trapped volume and said outlet via said corresponding one of said port means, (c) valve means coacting with said corresponding one of said port means and having a first position in which said valve means blocks said corresponding one of said port means, a second position in which said valve means permits fluid communication between a trapped volume and said outlet via said corresponding one of said port means to reduce the discharge pressure to suction pressure ratio in said compressor means and a third position in which said valve means permits fluid communication between a trapped volume and said inlet via said corresponding one of said port means to unload said compressor means.

15. The compressor means of claim 14 further including means for moving aid valve means between said first, second and third positions.

16. A positive displacement compressor means having an inlet and an outlet comprising:

fixed and movable means coacting to establish trapped volumes in a compression cycle in which said trapped volumes sequentially are cut off from fluid communication with said inlet, moved relative to said fixed means and brought into fluid communication with said outlet;

a plurality of port means in said fixed means a spaced locations such that each of said plurality of port means is in fluid communication with a trapped volume during said compression cycle;

each of said plurality of port means having associated therewith:

(a) first fluid passage means for providing fluid communication between a trapped volume and said inlet via a corresponding one of said port means, (b) second fluid passage means for providing fluid communication between a trapped volume and said outlet via said corresponding one of said port means, (c) valve means coacting with said corresponding one said port means and having a first position in which said valve means blocks said corresponding one of said port means, and a second position in which said valve means permits fluid communication between a trapped volume and said inlet and outlet via said corresponding one of said port means, (d) selectively positioned valve means for controlling fluid flow in said first passage means and movable between a closed position blocking flow and an open position permitting flow in said first passage means, (e) fluid pressure responsive valve means for controlling fluid flow in said second passage means, whereby when said valve means coacting with said corresponding one of said port means is in said second position fluid communication is established between said corresponding one of said port means and said inlet via said first fluid passage means to unload said compressor means when said selectively positioned valve means is in said open position and fluid communication is established between said corresponding one of said port means and said outlet via said second fluid passage means to reduce the discharge pressure to suction pressure ratio in said compressor means when said selectively positioned valve means is in said closed position and fluid pressure in said fluid passage means opens said fluid pressure responsive valve means.

* * * * *